United States Patent [19]

Wittstein et al.

[11] Patent Number: 4,561,567

[45] Date of Patent: Dec. 31, 1985

[54] TONER LOADING APPARATUS

[75] Inventors: Martin D. Wittstein, Fairfield; Christian A. Beck, Ridgefield, both of Conn.

[73] Assignee: Pitney Bowes Inc., Stamford, Conn.

[21] Appl. No.: 572,276

[22] Filed: Jan. 20, 1984

[51] Int. Cl.[4] ..... B67B 7/48

[52] U.S. Cl. ..... 222/83.5; 222/89; 222/541; 30/1.5; 141/98; 141/330

[58] Field of Search ..... 222/81, 89, 80, 83, 222/541, 511, 83.5; 30/1.5, 436, 442, 447, 433; 141/329, 330, 319, 320, 321, 322, 98

[56] References Cited

U.S. PATENT DOCUMENTS

| | | | |
|---|---|---|---|
| 3,404,811 | 10/1968 | Cernei | 222/83 |
| 3,465,924 | 9/1969 | Michaels | 222/511 |
| 3,599,682 | 8/1971 | Altmann | 222/81 X |
| 3,853,246 | 12/1974 | Dubois | 222/DIG. 1 X |
| 4,217,072 | 8/1980 | Boström | 30/433 X |
| 4,237,943 | 12/1980 | Ermel et al. | 222/DIG. 1 X |
| 4,304,273 | 12/1981 | Caudill et al. | 222/238 X |
| 4,371,015 | 2/1983 | Simons | 222/81 X |
| 4,441,636 | 4/1984 | Yamashita et al. | 222/DIG. 1 X |

*Primary Examiner*—Joseph J. Rolla
*Assistant Examiner*—Nils E. Pedersen
*Attorney, Agent, or Firm*—Martin D. Wittstein; William D. Soltow, Jr.; Albert W. Scribner

[57] ABSTRACT

A xerographic copying machine is adapted to receive toner supplied from an inverted toner supply bottle having a frangible seal member covering its outlet. The toner bottle is inserted by an operator through an access receptacle within the copier which normally covers a toner developing apparatus and toner supply container. During insertion, mutually engaging components of the toner bottle and a cooperating connecting apparatus are aligned to enable operative association of the components when the toner bottle is manually turned. In addition, during insertion the frangible seal member normally sealing the toner bottle dispensing opening is punctured by a piercing member associated with an actuating device including a cutting device rotatably mounted on the connecting apparatus. When the bottle is turned, the piercing member is caused to rotate within the neck opening of the bottle, thereby helping the toner to be dumped through the toner loading apparatus and into the toner supply container.

5 Claims, 6 Drawing Figures

36
18
70
34
32
16
52
42
54
53
44
128
20
68
64
78
28
66
30
120
126
112
108
130
102
114
116
14
122
124
118
10
12

TONER LOADING APPARATUS

BACKGROUND OF THE INVENTION

1. Field of the Invention

This invention relates generally to the field of electrostatic copying machines of the type which utilize a dry toner developing material to render visible an electrostatic latent image produced on a photoconductive recording medium. More particularly, the invention relates to an apparatus for periodically replenishing the supply of the dry toner developing material stored in the copying machine where the supply of developing material has been depleted to a low volume from normal use of the copying machine.

As is well known in the field today, the typical electrostatic copying machine which operates on the xerographic process includes a photoconductive member on which a latent electrostatic charge image of graphic information on an original document is created by selective discharge of a uniformly charged photoconductive member. The latent image is rendered visible by applying thereto a suitable electrostatic marking material such as dry toner developing material, after which the visible toner image is transferred to a sheet of paper and is permanently affixed thereto by suitable means, usually heating.

The developing material used in most present day electrostatic copying machines consists of a very finely ground carbon base powder which is extremely difficult and messy to handle, and is difficult to clean from machine parts, hands and clothing. Because of its very fine nature, it is difficult to pour from a bottle because it bridges at the neck of the bottle, thereby requiring a certain degree of shaking or rolling of the bottle or other agitation of the powder. In addition, pouring dry toner powder from a bottle or package into the storage receptacle of a copying machine is undesirable for the reason that inevitably carbon toner dust rises as a cloud and both settles on adjacent machine parts and is carried out into the room through vent fans or other openings. As toner dust accumulates on the mirrors and lenses of the optical system in the copying machine, the quality of the copy degrades and ultimately becomes unacceptable if these machine parts are not periodically cleaned. Further, any accumulation of toner dust, even in minute quantities, in any of the sensitive electronic control components of the copying machine can easily result in malfunctioning of the machine which normally requires servicing beyond the capability of the operator. Also, toner which may either contact an operator's hands or get on his clothing is very difficult to remove and often permanently stains certain materials. Another serious problem is that the toner dust, if inhaled in even small amounts, may cause respiratory tract irritation resulting in coughing and sneezing, which may have serious consequences for anyone with chronic respiratory conditions.

It is apparent from the foregoing that there exists a variety of troublesome and in some cases serious problems which result from handling dry toner developing materials in a conventional manner, such as by pouring directly from a bottle into the toner storage receptacle of the copying machine. Nevertheless, because of the gradual consumption of the developing material during the copying process it must be periodically replenished.

2. The Prior Art

The most common solution to the above problems is to provide a containerized system for periodically replenishing the dry toner developing material. There are generally two types of containerized systems currently in use, in one of which the toner material is stored in a bottle or other container mounted in a suitable receptacle, and a dispensing device is provided in the bottle or other container for metering the flow of toner material from the bottle to a storage receptacle in the copying machine at a suitable state depending upon the rate of consumption of the toner material during the copying operation. Such a system is shown in U.S. Pat. No. 3,853,246, a principal disadvantage of which is the relatively high expense of the bottle with the dispensing device therein, since the bottle is not reused after it becomes empty.

The other and more preferable type of containerized system, as shown in U.S. Pat. Nos. 4,237,943 and 4,304,273 includes a container having suitable means for sealing the toner material therein until it is ready for use, the container and copying machine having cooperating means for mounting the container on the copying machine so that the toner merely falls by gravity into a storage receptacle in the copying machine. Preferably the sealing means is such that it is removed after the toner bottle is in place in a dispensing position. One disadvantage with the system shown in the U.S. Pat. No. 4,237,943 patent is that it is necessary to physically handle a closure member which is in contact with toner material in order to open the container, thus leaving the possibility that some toner may be deposited on machine parts or the hand or clothing of an operator.

A significant disadvantage of the device shown in the U.S. Pat. No. 4,304,273 patent is that the dispensing opening from the bottle is so small that the developing material has a tendency to bridge therefore requiring agitation of the bottle which tends to raise a cloud of developing material which settles on adjacent machine parts.

SUMMARY OF THE INVENTION

The present invention either obviates or substantially eliminates the aforementioned problems and disadvantages of both manual toner material replenishing methods and the containerized toner material replenishing systems shown in the referenced patents as well as others which are in practice. The present invention achieves this by providing a toner material container which normally sealed prior to use, is automatically unsealed and opened for dispensing in the course of being inserted into the copying machine, and promptly dispenses all of its contents by gravity flow into a storage receptacle in the copying machine which is sufficiently enclosed to prevent a cloud of toner dust for rising from the receptacle. Thus, the toner material is totally confined at all times, and there are no toner contaminated parts of the container which must be handled by the operator.

To this end, the present invention, in its broader aspect, is an apparatus for periodically replenishing dry toner developing material into a storage receptacle of a copying machine and comprises a bottle having a neck adjacent one end defining a dispensing opening into the bottle. The opening is covered by a frangible sealing member secured to the bottle neck for normally sealing the dispensing opening. There is a cutting apparatus rotatably mounted on the copying machine adjacent to the supply container with a first and second cooperating connecting apparatus respectively mounted on the copying machine, the first adjacent to the supply container and the second on the the bottle neck for removably connecting the bottle to the copying machine in a position such that the cutting apparatus pierces the frangible sealing member while the dispensing opening is disposed adjacent the supply container. There is a first and second actuating devices interconnected respectively between the cutting apparatus and the bottle for causing rotation of the cutting apparatus relative to the bottle in response to rotation of the bottle. The cutting apparatus cuts the sealing member around substantially the periphery of the bottle neck to expose the dispensing opening, thereby allowing toner within the bottle to flow by gravity through the dispensing opening into the supply container.

The first cooperating connecting apparatus includes an apparatus on the copying machine adjacent the supply container, defining an aperature for receiving the bottle neck. There is a first locking element and a second locking element mounted on the bottle for disengagement with the first locking element when the bottle is in a predetermined rotary position with respect to the aperture, but is non-removable with respect to the first locking element when the bottle is rotated to any other position than the predetermined position where the bottle is locked into operative engagement with the copying machine. The first and second actuating devices includes a driving member mounted on the bottle neck which forms the second actuating device, and a rotatable device mounted on the copying machine forming the first actuating device for rotating the cutting apparatus in response to rotation of the driving member. The driving member and rotatable device are engageable by insertion of the bottle neck through the aperature.

With the foregoing in mind, it is an object of the present invention to provide an apparatus for periodically loading toner into a toner supply container within a copying machine by avoiding the shortcomings of the prior art.

It is another object of the present invention to provide a toner loading apparatus which aides in emptying the toner bottle to ensure complete emptying of the bottle's contents.

It is another object of the present invention to provide a toner bottle having a substantially large dispensing opening in the bottle neck.

It is yet another object of the present invention to provide a toner loading apparatus including a sealing member covering the dispensing opening of the toner bottle which does not interfere with emptying of toner from the bottle.

DESCRIPTION OF THE PREFERRED EMBODIMENT

Figure 1:
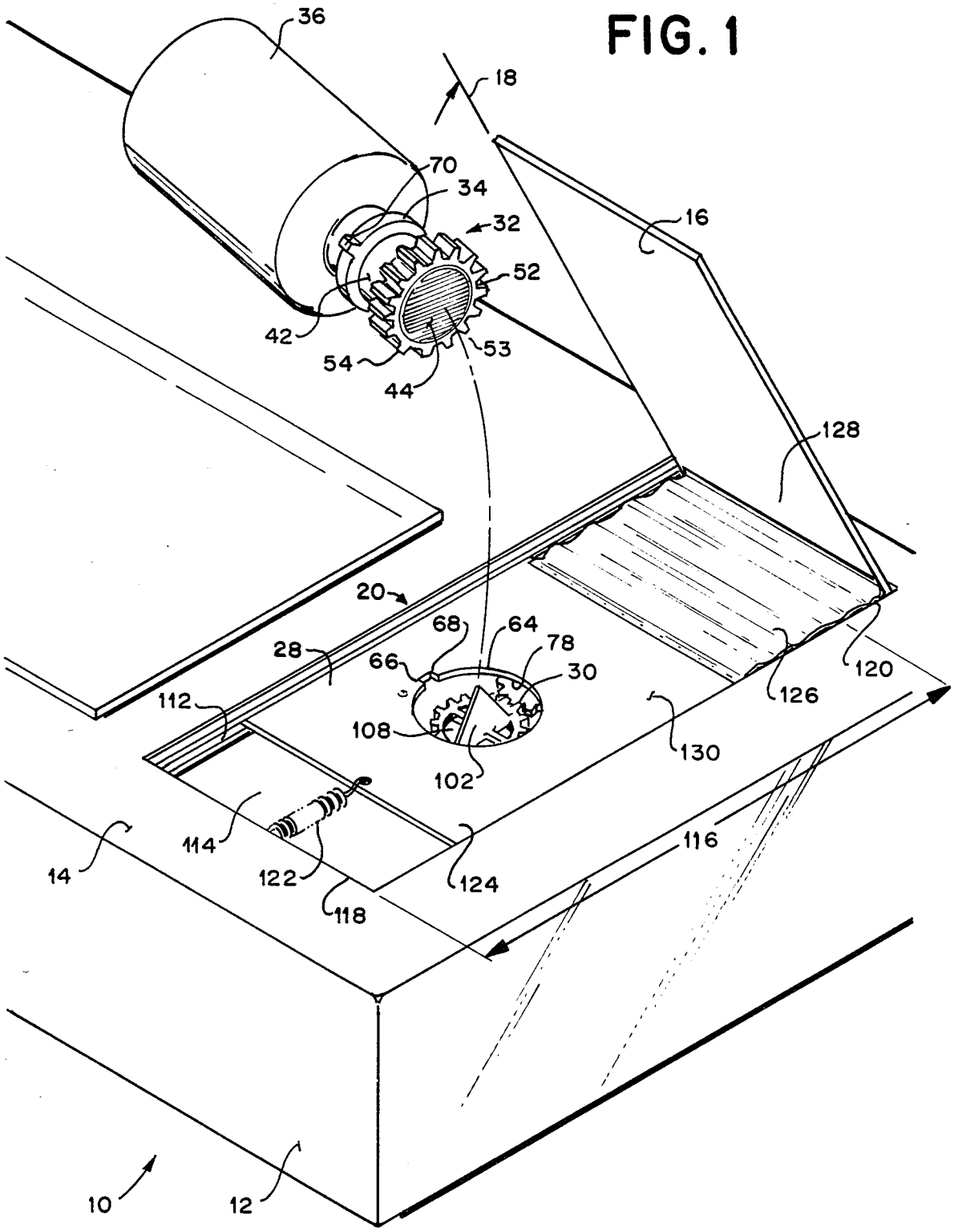
FIG. 1 represents a top isometric view of one end of a xerographic copying machine having access through a horizontal top cover including a trap door which when opened exposes a cooperating connecting apparatus for loading toner to a toner supply chamber.

Referring to FIG. 1, there is shown a xerographic copying machine 10 of the type which utilizes dry toner developer material in the toner developing apparatus (not shown).

For a more complete explanation of the workings of a dry toner developing apparatus, reference may be made to U.S. Pat. No. 4,274,362 entitled MAGNETIC BRUSH MIXING AUGERS, issued to Beck et al. Within the present specification, the dry toner developing apparatus (not shown) is not explained nor illustrated within the drawings, however, the previously mentioned patent will provide a detailed description of such a dry toner developing apparatus and its function in an electrophotographic copier such as that where the present invention is utilized. It will be understood that the dry toner developing apparatus is appropriately located and operated within the copying machine 10, within the inside limits of the outer copier covers 12. As shown in FIG. 1 within an upper, horizontal cover 14 of the copier 10, there is a pivotable trap door 16 shown in the open position 18, thereby exposing a toner loading apparatus 20.

Figure 2:
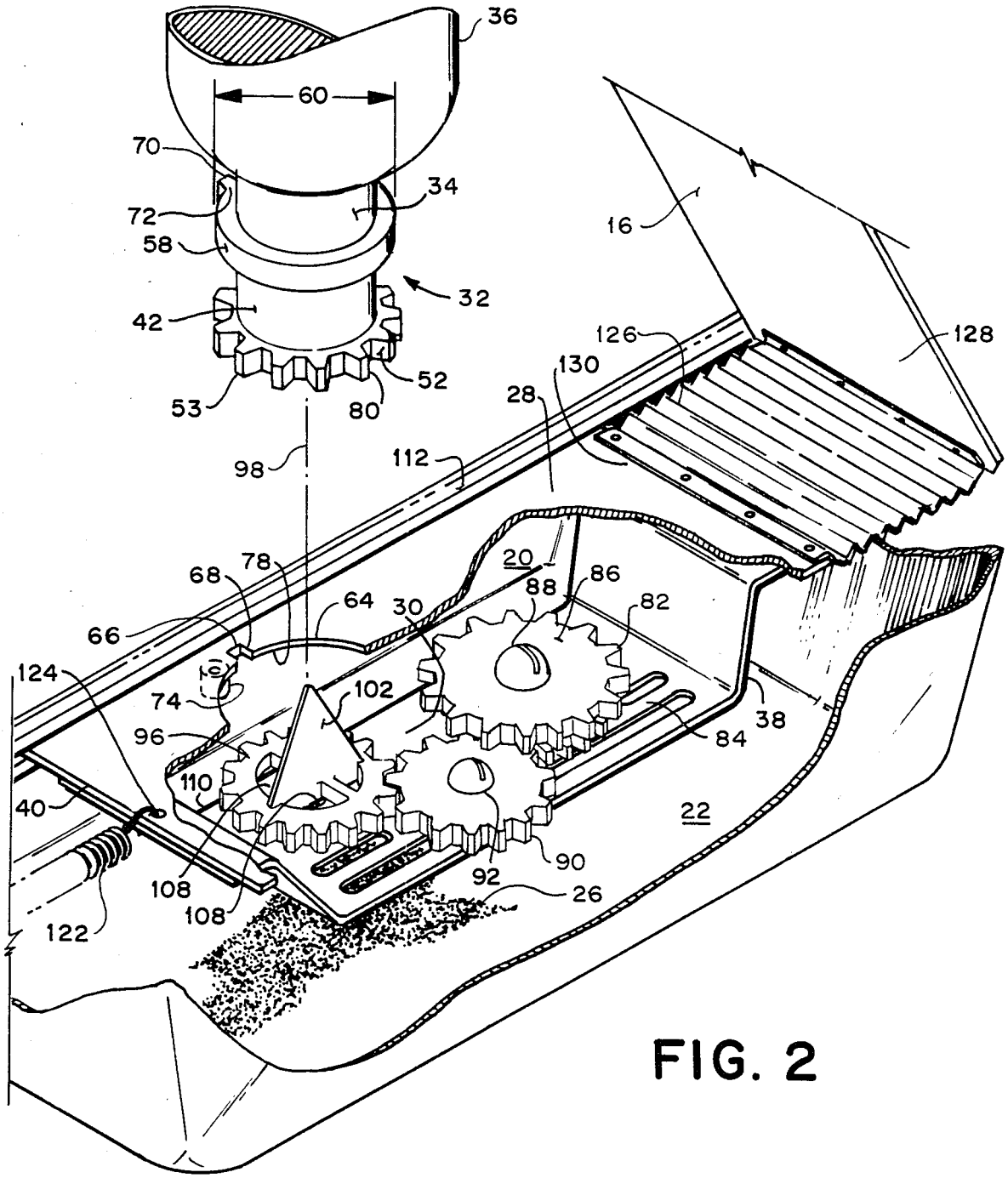
FIG. 2 is an enlarged, exploded isometric view of the cooperating connecting apparatus and toner supply chamber of FIG. 1 shown along with a portion of a toner supply bottle with an attached dispensing cap member.

Directly beneath the toner loading apparatus 20, there is a toner supply chamber 22 (FIG. 2). The toner supply chamber 22 generally lies over the (unshown) dry developing apparatus for the purpose of providing a supply of toner 26 to that apparatus.

There is a frame member 28 which lies in a parallel and horizontal plane with respect to the horizontal cover 14. Appropriately located within the frame member 28 there is a first cooperating connecting apparatus 30 which is suitably shaped to fit a toner bottle cap member 32 or a neck 34 of a toner supply bottle 36. It is optional to provide one of several forms of the toner supply bottle 36 from the manufacturer, with or without a separate cap member such as the toner bottle cap member 32 illustrated in the accompanying drawings. Referring to FIG. 2 the toner supply bottle 36 is represented as a two piece unit, assembled to include the cap member 32, and the toner supply bottle 36. It is intended in the present disclosure that the toner bottle 36 as such and the cap member 32 be essentially one piece, that is, that they are conveniently cemented or sonically welded together at their juncture to form an inseparable assembly constituting a one piece unit.

However, as mentioned, it is not necessary to have separate pieces to form the toner supply bottle 36 since it is possible to form or mold the toner supply bottle 36 in substantially one piece from a suitable plastic such as polyethylene, with all of the various details to be described henceforth of the cap member 32 included. Referring especially to FIG. 2, there is a formed plate member 38 suitably attached to the frame 28, both of which unitarily form a multilayered support frame 40, capable of supporting rotatable components included within the toner loading apparatus 20, such as the first cooperating connecting apparatus 30.

Figure 3:
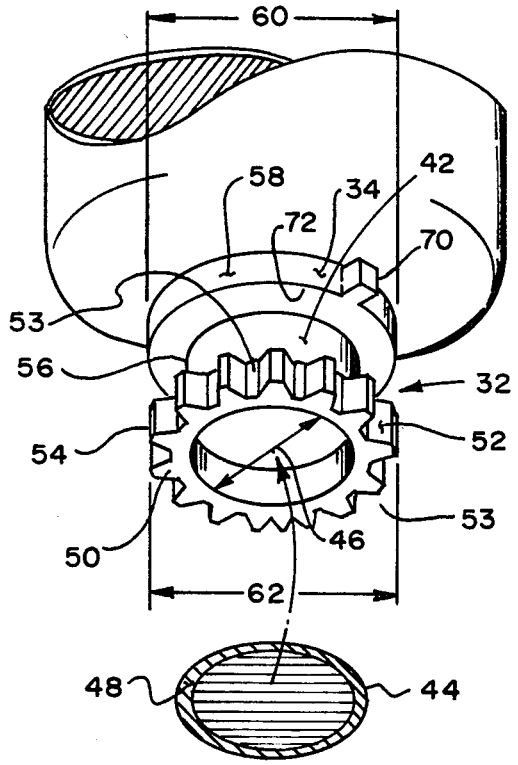
FIG. 3 is a partial isometric view of the open end of the toner supply bottle, and detached frangible sealing member.
Figure 4:
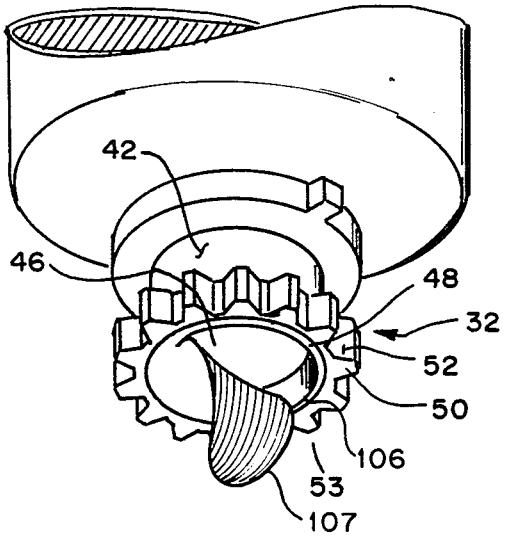
FIG. 4 is a partial isometric view of the toner bottle shown in FIG. 3, showing the frangible sealing member opened by the result of installing and unloading the toner bottle.
Figure 5:
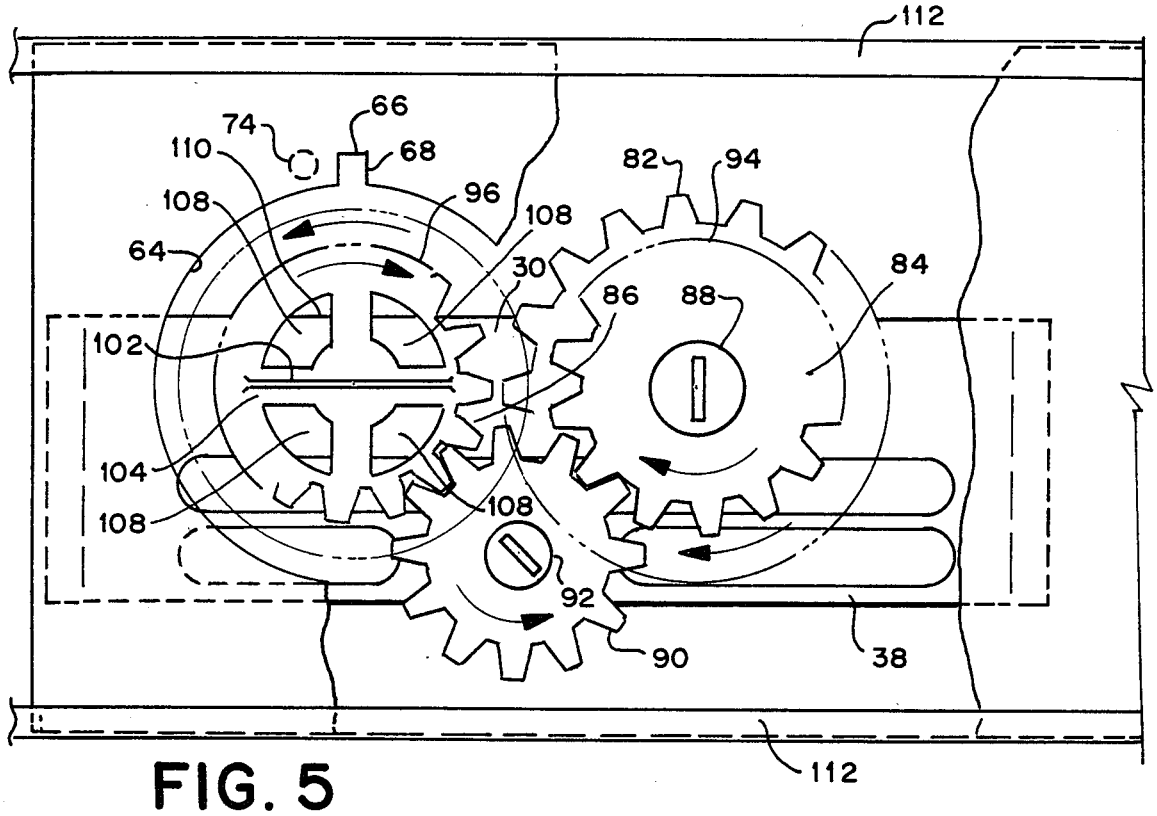
FIG. 5 is an enlarged top view of the cooperating connecting apparatus of FIG. 1.
Figure 6:
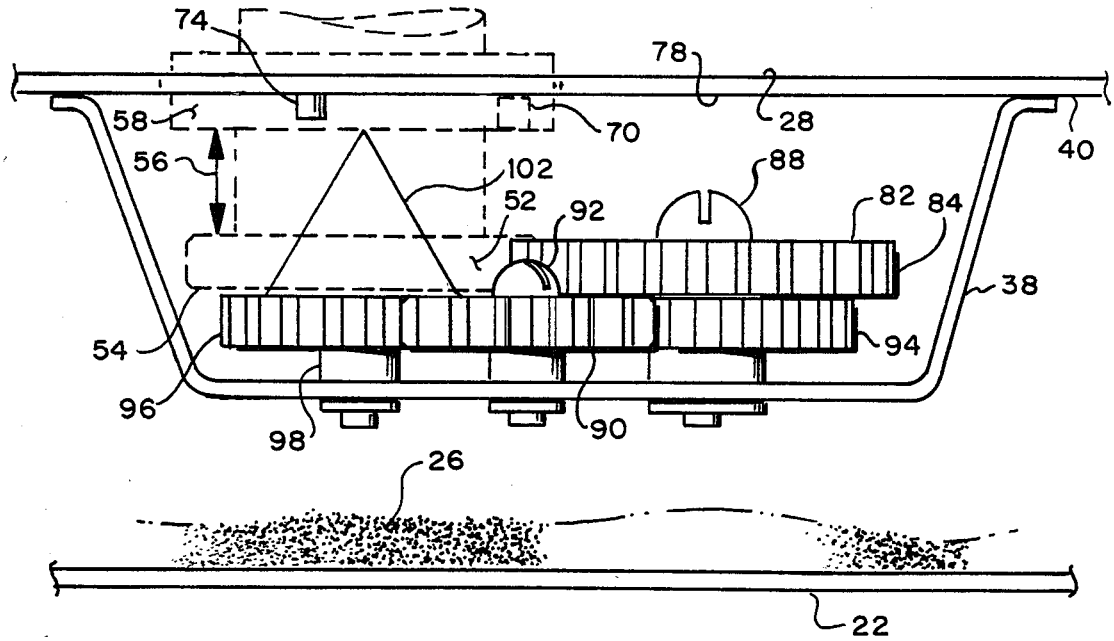
FIG. 6 is an end view taken from FIG. 5 of the cooperating connecting apparatus with the toner supply bottle, and the cooperating connecting apparatus in position for dumping toner.

At such time that the toner supply bottle 36 is brought into engagement with the respective cooperating connecting apparatus within the toner loading apparatus 20, a number of interrelating parts are interconnected as will not be defined, including the details and components which supplement the connecting apparatus as such. Included within a second cooperating connecting apparatus 42 there is a frangible sealing member 44, which covers a dispensing opening 46 of the cap member 32. The frangible sealing member 44 is manufactured of a suitable aluminum foil or equivalent material having a self sticking ring portion 48 which, when applied to a exterior annular portion 50 of the dispensing opening 46, assures a hermetical seal for the contents of the toner supply bottle 36. The frangible sealing member 44 is applied when a fresh supply of toner is loaded into the supply bottle 36 by the commercial toner supply manufacturer. Other details of the cap member 32 are seen in FIG. 3, including a driving member 52, which is part of a second actuating apparatus 53, located adjacent to the dispensing opening 106 substantially at an end 54 of the neck 34 of the bottle 36 as such. There is an annular groove 56 located in a plane parallel to the driving member 52, substantially set at a right angle with respect to the elongated body of the bottle 36. And there is a flange member 58 having an outside diameter 60 (FIG. 2), substantially the same size as an outside diameter 62 (FIG. 3), of the driving member 52. The main purpose of the flange member 58 is to guide and maintain the toner supply bottle 36 is a substantially upright position when it is aligned and inserted into a aperture 64 located within the frame member 28. There is a first locking element 66, which is comprised of a radially, outwardly protruding slot 68 formed in the aperture 64 for interconnecting in a predetermined manner with a second locking element 70 within the second cooperating connecting apparatus 42. The second locking element 70 is formed from a periphery 72 of the flange member 58. The shape of the second locking element 70 closely matches the shape of the first locking element 66. There is a predetermined timed relationship of the angular position of the first locking element 66 with respect to insertion of the toner supply bottle 36 and to the toner loading apparatus 20, as will be described henceforth. The FIGS. 3, 4 and 5 are helpful to clearly see the respective relationships of the various components being described as the procedure for interconnecting the first and second cooperating connecting apparatus 30 and 42 respectively is now explained.

There is a pin member 74 appropriately secured at a predetermined angular position with respect to the first and second locking elements 66 and 70, respectively. This provides a stop for angularly positioning the toner supply bottle 36, after a predetermined rotation of the bottle 36 following insertion. In order to insert the toner supply bottle 36 into the first cooperating connecting apparatus 30, the operator simply aligns the cap member 32 with the aperture 64 so that the second locking element 70 can pass beneath an underside surface 78 of the frame member 28 thereby locking the toner supply bottle 36 to the first cooperating connecting apparatus while the bottle 36 is manually rotated by the operator.

At the same time that the toner supply bottle 36 is pushed down as previously explained, the driving member 52 which is defined in the present specification as a gear 80, (having 15 teeth), will align and engage an additional gear 82, having 15 teeth. The gear 82 is part of a compound gear 84 located within a first actuating apparatus 86. The compound gear 84 is suitably rotatably mounted on a fixed stud 88 and is meshed with a third gear 90, which in turn is rotatably mounted on another fixed stud 92. The lower portion of the compound gear 84, has a second gear 94 with 13 teeth or less for engagement with the third gear 90. Both the studs 88 and 92 are appropriately fixedly secured to the formed plate member 38 for the purpose of permitting free rotation of all interconnected gears described. There is also a fourth gear 96, similarly mounted and located on a stud 98 fixed to the formed plate member 38. The fourth gear 96 is located in relative axial alignment with an axis 98 of the driving member 52 but may be axially offset if necessary in order to accomplish the dumping of the toner to the toner supply chamber 22.

The fourth gear 96 is manufactured from an appropriate plastic, or metal, whichever is more cost effective so that at least one upstanding pointed blade member 102 is formed from a body web 104 of the mentioned gear. The upstanding pointed blade member 102 is positioned to appropriately align with the frangible sealing member 44 covering the previously described dispensing opening 46 in order to pierce the same when the toner supply bottle 36 is pushed downwards into the first cooperating connecting apparatus 30. At the same time, driving member 52 meshes with the compound gear 84 at the additional gear 82, with a relatively loose engagement which allows free turning of all gears previously described in the first cooperating connecting apparatus 30 and the first actuating apparatus as driven by the second actuating apparatus 53. The gears described in the preceding text have a ratio as determined by the requirement that the fourth gear 96, turn with the upstanding pointed blade member 102, so that only a partial full revolution occurs, when the toner supply bottle 36 is manually rotated. It was described earlier, that the bottle 36 can only be turned to the predetermined angular position defined by the first and second locking elements 66 and 70 respectively, where the second locking element 70 stops against the pin member 74, after the required bottle 36 rotation. Therefore, the ratio as defined by the gears in the present embodiment gives a 15/13 reduction of a turn from the driving member 52 to the output gear which is the fourth gear 96. In other words, the ratio as defined in the gear train is such that the fourth gear 96 turns a fraction of a full revolution that the bottle 36 turns, which is determined to substantially agree with the predetermined limit stop set up by the first and second locking elements 66 and 70 respectively and the pin member 74. The driving member 52 has 15 teeth, as mentioned previously, while the additional gear 82 has 15 teeth, and the second gear 94 of the compound gear 84 has 13 teeth. The third gear 90 is an idler, which can have whatever number of teeth is appropriate to define a meshing relationship from the compound gear 84 to the fourth gear 96 as is necessary. And, the fourth gear 96 has 15 teeth, to agree with the ratio defined. It will be recognized from the preceding description of the gears as such and accompanying components within the first and second respective actuating apparatus's 86 and 53, that the upstanding pointed blade member 102 cuts the frangible sealing member 44 while the operator is turning the toner supply bottle 36. The sealing member 44 as such is cut in a substantially circular path defined by a periphery 106. The toner contained within the toner supply bottle 36 is thereby effectively dumped through the resulting opening defined by the dispensing opening 46, even though there is not a full circular opening therein, as determined by a flap 107 left of the frangible sealing member 44, purposely left in tact with the remainder of the shelf sticking ring portion 48 of the member 44, which does not interfere with the flow of toner downwardly through the neck 34. It will also be recognized that the number, shape and relative position of the upstanding pointed blade member 102 may be advantageously altered in order to achieve various effects in cutting the frangible sealing member 44. However, for illustration purposes and simplicity one is described in the present disclosure.

The toner dumps from the bottle 96 by passing through the neck 34. The toner then passes through the aperture 64, and through an opening 108, typically provided between the rib sections of the fourth gear 96, such as the body web 104 and then downwardly past an end 110 of the formed plate member 38 and eventually to the toner supply chamber 22 lying beneath the frame member 28. In addition to the foregoing described apparatus, there is yet another feature included with the toner loading apparatus 20. There is a suitable elongated supporting member 112 mounted on opposing sides within a rectangular opening 114, beneath the pivotable trap door 16 for the purpose of suspending the first cooperating connecting apparatus 30 for lateral reciprocating movement over the toner supply chamber 22. The first cooperating connecting apparatus 30 may be reciprocated by hand, back and forth along a substantial width 116 of the toner supply chamber 22. The toner supply bottle 36 is meanwhile locked in engagement with the previously described locking apparatus, and there is a resulting jarring effect upon the bottle's contents. There is an end 118, and an end 120 of the rectangular opening 114 which defines the limits of travel (FIG. 1).

The jarring effect thus dislodges any toner remaining within the neck 34 or bottle 36. There is a resilient member in the form of a tension spring 122 attached to one end 124 of the frame member 28 to cause an automatic return of the entire toner loading apparatus 20 to a relatively closed position at the end 118 in the rectangular opening 114. A flexible shield 126, attached to a lower portion 128 of the pivotable trap door 16 and to an end 130 of the frame member 28 prevents any inadvertent objects from accidently being dropped into the toner supply chamber 22 while also ensuring that toner will only be loaded through the cooperating connecting apparatus previously described. The flexible shield 126 also prevents any resulting dust cloud of toner from rising into the rectangular opening 114, which otherwise would cause a contamination problem.

Therefore, having described an embodiment of the present invention for periodically loading toner into a toner supply chamber, it is pointed out that various modifications may be made to the parts described within the foregoing specification or drawings which will serve the same purpose outlined and captured by the accompanying claims.

What is claimed is:

1. In a xerographic copying machine having instrumentalities for making xerographic copies of original documents, one of said instrumentalities being a toner developing apparatus which utilizes dry toner stored in a supply container, apparatus for periodically loading toner into said supply container, said apparatus comprising:

A. a bottle having a neck adjacent one end thereof and defining a dispensing opening from said bottle;

B. a frangible sealing member secured to said neck and normally sealing said dispensing opening;

C. cutting means rotatably mounted on said copying machine adjacent said supply container, said cutting means comprising a member extending substantially across said dispensing opening and having an upwardly projecting piercing point and being mounted for rotation about a substantially central vertical axis of said member;

D. first and second cooperating connecting means respectively mounted on said copying machine adjacent said supply container and on said bottle adjacent said neck for removably connecting said bottle to said copying machine in a position such that said piercing point pierces said sealing member and said dispensing opening is disposed adjacent said supply container; and E. first and second actuating means mounted respectively on said copying machine and said neck of said bottle and interconnected between said cutting means and said bottle for causing rotation of said cutting means relative to said bottle in response to rotation of said bottle so that said cutting means cuts said sealing member around substantially the periphery of said neck to expose said dispensing opening, thereby allowing toner in said bottle to flow by gravity through said dispensing opening and into said supply container.

2. Apparatus as set forth in claim 1 further including means mounted on the copying machine for movably supporting said cutting means, said first cooperating connecting means and said first actuating means for lateral reciprocating movement relative to said supply container thereby permitting corresponding lateral displacement and simultaneous rotation of said bottle after said bottle is connected to said copying machine and while said cutting means is disposed within said neck of said bottle to agitate the contents of said bottle during dispensing and prevent bridging of toner passing through said dispensing opening.

3. Apparatus as set forth in claim 1 wherein:

A. said second actuating means comprises; a driving member mounted on said neck of said bottle, and B. said first actuating means comprises; means mounted on said copying machine for rotating said cutting means in response to rotation of said driving member, said driving member and said rotating means being engagable by insertion of said bottle neck through said aperture.

4. Apparatus as set forth in claim 3 wherein said driving member comprises a first gear and said rotating means includes a least one additional gear engaged by said first gear and connected to said cutting means.

5. Apparatus as set forth in claim 4 wherein said cutting means comprises an upstanding pointed blade member adapted to pierce said sealing member as said bottle neck is moved through said aperture and to cut said sealing member during rotation of said bottle.

* * * * *